US011398199B2

(12) United States Patent
Xiao et al.

(10) Patent No.: US 11,398,199 B2
(45) Date of Patent: Jul. 26, 2022

(54) LIQUID CRYSTAL DISPLAY DEVICE, DRIVING SYSTEM THEREOF AND DRIVING METHOD THEREOF

(71) Applicants: Wuhan BOE Optoelectronics Technology Co., Ltd., Hubei (CN); BOE Technology Group Co., Ltd., Beijing (CN)

(72) Inventors: Lijun Xiao, Beijing (CN); Feng Jiang, Beijing (CN); Mengchao Shuai, Beijing (CN); Junmin Zhang, Beijing (CN); Hangyu Chen, Beijing (CN); Meng Feng, Beijing (CN); Jianmin Xiang, Beijing (CN); Bing Li, Beijing (CN)

(73) Assignees: Wuhan BOE Optoelectronics Technology Co., Ltd., Wuhan (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/528,652

(22) Filed: Nov. 17, 2021

(65) Prior Publication Data

US 2022/0165227 A1 May 26, 2022

(30) Foreign Application Priority Data

Nov. 24, 2020 (CN) ..... 202011334095.2

(51) Int. Cl.
*G09G 3/36* (2006.01)

(52) U.S. Cl.
CPC ..... *G09G 3/3607* (2013.01); *G09G 2310/027* (2013.01)

(58) Field of Classification Search
CPC ..... G09G 2320/0252; G09G 2340/16; G09G 2310/061; G09G 2320/0261
See application file for complete search history.

(56) References Cited

U.S. PATENT DOCUMENTS

2009/0295838 A1* 12/2009 Tanigawa ..... G09G 3/3688 345/89
2010/0045708 A1* 2/2010 Higashino ..... G09G 3/3685 345/89
2011/0001743 A1* 1/2011 Yamato ..... G09G 3/3614 345/212
2014/0285406 A1* 9/2014 Kimura ..... G09G 3/3291 345/76
2019/0005879 A1* 1/2019 Shin ..... G09G 3/3233

* cited by examiner

*Primary Examiner* — Van N Chow
(74) *Attorney, Agent, or Firm* — IPro, PLLC

(57) ABSTRACT

A liquid crystal display device, a driving system thereof, and a driving method thereof are provided. A driving method includes: receiving display data of a next frame of image; determining whether the next frame of image includes a specific graph according to the gray scale information of each pixel; if the next frame of image includes the specific graph, determining information to be compensated according to positions of the first pixel section and the second pixel section, a quantity of the first pixels or a quantity of the second pixels and the difference value between the first gray scale and the second gray scale, where the information to be compensated includes a position of an area to be compensated and a compensation level of the area to be compensated; and generating a compensated driving voltage according to the position of the area to be compensated.

19 Claims, 8 Drawing Sheets

LIQUID CRYSTAL DISPLAY DEVICE, DRIVING SYSTEM THEREOF AND DRIVING METHOD THEREOF

CROSS-REFERENCE TO RELATED APPLICATION

The present disclosure claims priority to Chinese Patent Application No. 202011334095.2 filed in China on Nov. 24, 2020, the disclosure of which is hereby incorporated by reference in its entirely.

TECHNICAL FIELD

The present disclosure relates to the field of display technologies, and in particular, to a liquid crystal display device, a driving system thereof, and a driving method thereof.

BACKGROUND

A common electrode of an LCD (Liquid Crystal Display) is usually maintained at a specific electric potential, and a driving signal (data signal) is transmitted to a pixel electrode, so that an electric field is formed between the pixel electrode and the common electrode to drive Liquid Crystal molecules to deflect, thereby realizing image Display. In the related art, the gray level jump of a plurality of consecutive pixels causes Vcom of the common electrode in the region near the gray level jump position to deviate from a normal value, which affects the display effect of the LCD product, especially in the large-sized LCD product.

SUMMARY

The present disclosure provides a liquid crystal display device, a driving system thereof and a driving method thereof to solve the problem of color deviation of a specific area display caused by Vcom deviating from a normal value under the influence of a data signal in the related art.

In a first aspect, a driving method of a liquid crystal display device is provided in the present disclosure, where the liquid crystal display device includes a liquid crystal panel, and the driving method includes:

receiving display data of a next frame of image, where the display data includes gray scale information of each pixel in the next frame of image;

determining whether the next frame of image includes a specific graph according to the gray scale information of each pixel, where the specific graph includes a first pixel section and a second pixel section which are positioned in adjacent pixel rows, the first pixel section includes a plurality of continuous first pixels with first gray scales, the second pixel section includes a plurality of continuous second pixels which are with second gray scales and positioned in the same pixel row with the first pixel sections, and a difference value between the first gray scales and the second gray scales is larger than or equal to a first threshold value;

if the next frame of image includes the specific graph, determining information to be compensated according to positions of the first pixel section and the second pixel section, a quantity of the first pixels or a quantity of the second pixels and the difference value between the first gray scale and the second gray scale, where the information to be compensated includes a position of an area to be compensated and a compensation level of the area to be compensated; and generating a compensated driving voltage according to the position of the area to be compensated, the compensation level of the area to be compensated and the gray scale information of each pixel in the area to be compensated, where the compensated driving voltage is configured to drive the pixels in the area to be compensated in the liquid crystal panel.

Optionally, the determining information to be compensated according to the positions of the first pixel section and the second pixel section, the quantity of the first pixels or the quantity of the second pixels and the difference between the first gray scale and the second gray scale includes:

determining the information to be compensated according to the positions of the first pixel section and the second pixel section, the quantity of the first pixels or the quantity of the second pixels and the difference value between the first gray scale and the second gray scale by using a preset compensation model.

Optionally, the liquid crystal display device further includes a driving system electrically connected to the liquid crystal panel, the driving system includes a main control board and a driving chip;

the driving method further includes:

after the information to be compensated is determined, embedding, by the main control board, the information to be compensated into a transmission signal for transmitting display data and send the transmission signal to the driving chip; and the driving chip receiving the transmission signal, decoding the transmission signal to obtain the information to be compensated, and then generating the compensated driving voltage according to the position of the area to be compensated, the compensation level of the area to be compensated and the gray scale information of each pixel in the area to be compensated.

Optionally, the display data includes grayscale information of k pixels, and the embedding, by the main control board, the information to be compensated into the transmission signal for transmitting display data includes:

encoding pixels at a start position and pixels at an end position of the area to be compensated to generate a first data packet, and transmitting the first data packet through the transmission signals;

encoding the compensation level of the pixels at the start position and the compensation level of the pixels at the end position to generate a second data packet, and transmitting the second data packet through the transmission signal;

where the pixels at the start position and the pixel at the end position are both represented by n-bit binary digits, and $2^n \geq k$; the compensation level of the start position and the compensation level of the end position are both represented by m-bit binary digits, and $a2^m$ is equal to an adjustment range of a compensation voltage, where m, n and k are integers greater than or equal to 1, and a is an adjustment amplitude.

Optionally, the generating the compensated driving voltage according to the position of the area to be compensated, the compensation level of the area to be compensated and the gray scale information of each pixel in the area to be compensated includes:

generating a digital compensation signal according to the start position, the end position, the compensation level of the start position and the compensation level of the end position, and generating a digital display signal according to gray scale information of each pixel in the area to be compensated in the display data;

converting the digital compensation signal into a compensation voltage in an analog form, and converting a digital display signal into an original driving voltage in an analog form; and adjusting the original driving voltage of the corresponding pixel according to the compensation voltage of each pixel, to determine the compensated driving voltage of each pixel in the compensation area.

Optionally, the area to be compensated includes x rows and y columns of pixels, the pixels at the start position are the pixels at a first row and a first column in the area to be compensated, and the pixels at the end position are the pixels at a x-th row and a y-th column in the area to be compensated; the generating the digital compensation signal according to the start position, the end position, the compensation level of the start position and the compensation level of the end position includes:

obtaining the compensation level of the pixels at the first column of each row according to a set first function and the compensation level of the start position, obtaining the compensation level of the pixels of the y-th column of each row according to a set second function and the compensation level of the end position, and calculating the compensation level of the pixels of the second to the (y-1)-th columns of each row by using an interpolation method; and generating the digital compensation signal of each pixel according to the compensation level of each pixel in the area to be compensated.

Optionally, the next frame of image includes s display regions, s being an integer greater than or equal to 2, the receiving the display data of the next frame of image includes:

receiving the display data of the next frame of image in s steps, and receiving the display data of the display area of the next frame of image in each step.

A driving system of a liquid crystal display device is further provided in the present disclosure, including:

a main control board, configured to:

receive display data of a next frame of image, where the display data includes gray scale information of each pixel in the next frame of image;

determine whether the next frame of image includes a specific graph according to the gray scale information of each pixel, where the specific graph includes a first pixel section and a second pixel section which are positioned in adjacent pixel rows, the first pixel section includes a plurality of continuous first pixels with first gray scales, the second pixel section includes a plurality of continuous second pixels which are with second gray scales and positioned in the same pixel row with the first pixel sections, and a difference value between the first gray scales and the second gray scales is larger than or equal to a first threshold value;

if the next frame of image includes the specific graph, determine information to be compensated according to positions of the first pixel section and the second pixel section, a quantity of the first pixels or a quantity of the second pixels and the difference value between the first gray scale and the second gray scale, where the information to be compensated includes a position of an area to be compensated and a compensation level of the area to be compensated; embed the information to be compensated into a transmission signal for transmitting the display data, and send the transmission signal to a driving chip;

a driving chip is configured to receive the transmission signal, decode the transmission signal to obtain the information to be compensated and the display data, and generate a compensated driving voltage according to the position of the area to be compensated, the compensation level of the area to be compensated, and the gray scale information of each pixel in the area to be compensated, where the compensated driving voltage is configured to drive the pixel in the area to be compensated in the liquid crystal panel.

Optionally, the main control board includes a graphic detection module and a compensation module;

the graphic detection module is configured to determine whether the next frame of image includes a specific graph according to the gray scale information of each pixel, where the specific graph includes a first pixel section and a second pixel section which are positioned in adjacent pixel rows, the first pixel section includes a plurality of continuous first pixels with first gray scales, the second pixel section includes a plurality of continuous second pixels which are with second gray scales and positioned in the same pixel row with the first pixel sections, and a difference value between the first gray scales and the second gray scales is larger than or equal to a first threshold value;

the compensation module is configured to: if the next frame of image includes the specific graph, determine information to be compensated according to positions of the first pixel section and the second pixel section, a quantity of the first pixels or a quantity of the second pixels and the difference value between the first gray scale and the second gray scale, where the information to be compensated includes a position of an area to be compensated and a compensation level of the area to be compensated; embed the information to be compensated into a transmission signal for transmitting the display data, and send the transmission signal to a driving chip.

Optionally, the display data includes grayscale information of k pixels, the compensation module includes:

a first parameter register, configured to encode pixels at a start position of the area to be compensated;

a second parameter register, configured to encode pixels at an end position of the area to be compensated;

a third parameter register, configured to encode a compensation level of pixels at the start position;

a fourth parameter register, configured to encode a compensation level of pixels at the end position;

the first parameter register and the second parameter register are both n-bit registers, and $2^n \geq k$; the third parameter register and the fourth parameter register are m-bit registers, $a2^m$ is equal to an adjustment range of a compensation voltage, m, n and k are integers greater than or equal to 1, and a is an adjustment amplitude.

Optionally, the driving chip includes:

a digital part, configured to receive the transmission signal, decode the transmission signal to obtain the information to be compensated and the display data, and generate a digital display signal according to the start position, the end position, the compensation level of the start position and the compensation level digital compensation signal of the end position, and gray scale information of each pixel in the compensation area in the display data;

an analog part, configured to convert the digital compensation signal into a compensation voltage in an analog form, convert the digital display signal into an original driving voltage in an analog form, and adjust the original driving voltage of the corresponding pixel according to the compensation voltage of each pixel to determine a compensated driving voltage of each of the pixels within the compensation region.

Optionally, the analog part includes:

a first digital-to-analog converter, electrically connected to the digital part and configured to convert the digital display signal into the original driving voltage of each of the pixels in an analog form;

a second digital-to-analog converter electrically connected to the digital part and configured to convert the digital compensation signal into a compensation voltage of each of the pixels in an analog form; and a buffer, including a plurality of subtractors and a plurality of amplifiers, each subtractor is electrically connected with one amplifier, each subtractor is configured to adjust the original driving voltage of the corresponding pixel according to the compensation voltage of the pixel to generate a voltage to be amplified, and the amplifiers are configured to amplify the voltage to be amplified to generate a compensated driving voltage of the pixel.

Optionally, the next frame of image includes s display regions, s being an integer greater than or equal to 2;

the main control board further includes a signal input end, where the signal input end is configured to receive the display data of the next frame of image in s steps, and receive the display data of the display area of the next frame of image in each step.

A liquid crystal display device is further provided in the present disclosure, including a driving system;

where the driving system includes:

a main control board, configured to:

receive display data of a next frame of image, where the display data includes gray scale information of each pixel in the next frame of image;

determine whether the next frame of image includes a specific graph according to the gray scale information of each pixel, where the specific graph includes a first pixel section and a second pixel section which are positioned in adjacent pixel rows, the first pixel section includes a plurality of continuous first pixels with first gray scales, the second pixel section includes a plurality of continuous second pixels which are with second gray scales and positioned in the same pixel row with the first pixel sections, and a difference value between the first gray scales and the second gray scales is larger than or equal to a first threshold value;

if the next frame of image includes the specific graph, determine information to be compensated according to positions of the first pixel section and the second pixel section, a quantity of the first pixels or a quantity of the second pixels and the difference value between the first gray scale and the second gray scale, where the information to be compensated includes a position of an area to be compensated and a compensation level of the area to be compensated; embed the information to be compensated into a transmission signal for transmitting the display data, and send the transmission signal to a driving chip;

a driving chip is configured to receive the transmission signal, decode the transmission signal to obtain the information to be compensated and the display data, and generate a compensated driving voltage according to the position of the area to be compensated, the compensation level of the area to be compensated, and the gray scale information of each pixel in the area to be compensated, where the compensated driving voltage is configured to drive the pixel in the area to be compensated in the liquid crystal panel.

Optionally, the main control board includes a graphic detection module and a compensation module;

the graphic detection module is configured to determine whether the next frame of image includes a specific graph according to the gray scale information of each pixel, where the specific graph includes a first pixel section and a second pixel section which are positioned in adjacent pixel rows, the first pixel section includes a plurality of continuous first pixels with first gray scales, the second pixel section includes a plurality of continuous second pixels which are with second gray scales and positioned in the same pixel row with the first pixel sections, and a difference value between the first gray scales and the second gray scales is larger than or equal to a first threshold value;

the compensation module is configured to: if the next frame of image includes the specific graph, determine information to be compensated according to positions of the first pixel section and the second pixel section, a quantity of the first pixels or a quantity of the second pixels and the difference value between the first gray scale and the second gray scale, where the information to be compensated includes a position of an area to be compensated and a compensation level of the area to be compensated; embed the information to be compensated into a transmission signal for transmitting the display data, and send the transmission signal to a driving chip.

Optionally, the display data includes grayscale information of k pixels, the compensation module includes:

a first parameter register, configured to encode pixels at a start position of the area to be compensated;

a second parameter register, configured to encode pixels at an end position of the area to be compensated;

a third parameter register, configured to encode a compensation level of pixels at the start position;

a fourth parameter register, configured to encode a compensation level of pixels at the end position;

the first parameter register and the second parameter register are both n-bit registers, and $2^n \geq k$; the third parameter register and the fourth parameter register are m-bit registers, $a2^m$ is equal to an adjustment range of a compensation voltage, m, n and k are integers greater than or equal to 1, and a is an adjustment amplitude.

Optionally, the driving chip includes:

a digital part, configured to receive the transmission signal, decode the transmission signal to obtain the information to be compensated and the display data, and generate a digital display signal according to the start position, the end position, the compensation level of the start position and the compensation level digital compensation signal of the end position, and gray scale information of each pixel in the compensation area in the display data;

an analog part, configured to convert the digital compensation signal into a compensation voltage in an analog form, convert the digital display signal into an original driving voltage in an analog form, and adjust the original driving voltage of the corresponding pixel according to the compensation voltage of each pixel to determine a compensated driving voltage of each of the pixels within the compensation region.

Optionally, the analog part includes:

a first digital-to-analog converter, electrically connected to the digital part and configured to convert the digital display signal into the original driving voltage of each of the pixels in an analog form;

a second digital-to-analog converter electrically connected to the digital part and configured to convert the digital compensation signal into a compensation voltage of each of the pixels in an analog form; and a buffer, including a plurality of subtractors and a plurality of amplifiers, each subtractor is electrically connected with one amplifier, each subtractor is configured to adjust the original driving voltage of the corresponding pixel according to the compensation voltage of the pixel to generate a voltage to be amplified, and the amplifiers are configured to amplify the voltage to be amplified to generate a compensated driving voltage of the pixel.

Optionally, the next frame of image includes s display regions, s being an integer greater than or equal to 2;

the main control board further includes a signal input end, where the signal input end is configured to receive the display data of the next frame of image in s steps, and receive the display data of the display area of the next frame of image in each step.

According to the liquid crystal display device, the driving system and the driving method thereof provided by the embodiment of the disclosure, through detecting the display data, when the next frame of image is detected to include a specific graph, namely when the specific region in the next frame of image can generate Vcom deviating from a normal value, the original driving voltage of the specific region, namely the data voltage, is compensated to generate the compensated driving voltage, so that the electric field generated by the compensated driving voltage and the deviated Vcom can still control liquid crystal molecules to deflect at an expected angle, the deviation of the brightness of pixels in the specific region is avoided, and the display effect of an LCD product is improved.

DETAILED DESCRIPTION

Figure 1:
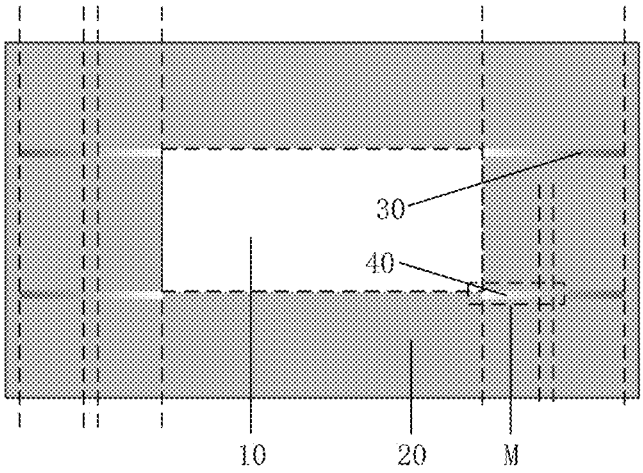
FIG. 1 is a diagram of a frame of a picture with a changed brightness of pixels in a specific area due to a deviation of Vcom from a normal value according to an embodiment of the present disclosure.

The present disclosure is described in detail below and examples of embodiments of the present disclosure are illustrated in the accompanying drawings, where like reference numerals refer to the same or similar elements or elements with the same or similar functionality throughout. In addition, if a detailed description of the known art is unnecessary for the features of the present disclosure shown, it is omitted. The embodiments described below with reference to the accompanying drawings are exemplary only for explaining the present disclosure and are not construed as limiting the present disclosure.

It will be understood by those within the art that, unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As used herein, the singular forms "a", "an", "the" and "the" include plural referents unless the content clearly dictates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

A common electrode of an LCD (Liquid Crystal Display) is usually maintained at a specific electric potential, and a driving signal (data signal) is transmitted to a pixel electrode, so that an electric field is formed between the pixel electrode and the common electrode to drive Liquid Crystal molecules to deflect, thereby realizing image Display.

Since liquid crystal molecules are in a deflection state for a long time, the liquid crystal molecules can generate polarization and gradually lose optical rotation characteristics, the data signal usually includes positive and negative frame voltages, i.e. the data voltages in two adjacent frames respectively present positive and negative voltages relative to Vcom, so that the driving voltages in the two adjacent frames make the liquid crystal charges move to different directions, thereby avoiding the polarization of the liquid crystal molecules. Based on this, the value of Vcom is usually set to be the middle value of the maximum positive value and the maximum negative value of the data voltage to ensure that the deflection degree of the liquid crystal molecules in different directions is basically consistent.

However, due to the coupling effect, the changed data voltage will affect Vcom, and the gray level jump between two adjacent pixels will have a smaller effect on Vcom, and will not affect the display effect, but when a plurality of consecutive pixels in a certain pixel row are in the same gray level and a plurality of consecutive pixels in the same pixel column in the next pixel row are in the same gray level, the gray level jump of the plurality of consecutive pixels will cause Vcom of the common electrode in the region near the gray level jump position to deviate from the normal value, which will affect the display effect of the LCD product, especially in the large-sized LCD product, the effect is more serious.

In the related art, Vcom at the position of the gray scale jump of the LCD screen deviates from a normal value, which affects brightness of pixels in a region near the position of the gray scale jump to change, thereby affecting a display effect. When the LCD displays the same screen for a long time, the display effect is more seriously affected by the gray level jump. For convenience of explanation, the region near the gray level transition position, i.e., the region where Vcom is shifted from the normal value, is referred to as a specific region hereinafter.

Taking a picture adopted in a testing stage of a liquid crystal panel as an example, as shown in FIG. 1, the picture is a picture with a gray background and a white rectangle in the middle, that is, the picture includes a white first area 10 and a gray second area 20 located around the first area 10, and due to gray level jump, the picture may generate brightness change, that is, Crosstalk (Crosstalk) problem in a specific area 30. For another example, when the LCD panel displays an image with stripes or grid lines like checkerboards, the liquid crystal positive and negative frame voltages are not uniform due to Vcom coupling, and the polarization causes a line image sticking problem. The Crosstalk problem and the line sticking problem are more easily generated in large-sized LCD products.

The related art mainly solves the line image sticking problem and the Crosstalk problem by performing reverse compensation on the pulled Vcom or adjusting the center position of the Vcom signal of the corresponding common electrode.

The pulled Vcom is reversely compensated, the Vcom signals are mainly detected, then compensation is carried out according to the detected Vcom signals, but the disturbance can be reduced as much as possible but cannot be completely eliminated, the compensation effect is obvious only in the range of compensated access points, the access points of large-size LCD products are all arranged around the panel, and the compensation effect on the middle position of the display screen is poor.

The problem of line image sticking can be improved by adjusting the central position of the Vcom signal of the corresponding common electrode, but the Vcom signal of a Vcom section (except for a plurality of lines needing compensation) without disturbance can deviate from the central position of the positive and negative Data signals, so that the problem of surface image sticking is caused, namely the voltage transferring directions of the optimization effects of the line image sticking and the surface image sticking are just opposite to that of the Vcom, therefore, only one Vcom voltage with light line image sticking and surface image sticking can be selected, namely, the problem of the line image sticking cannot be well solved after adjustment, and the problem of the surface image sticking can be generated.

The present disclosure provides a liquid crystal display device, a driving system thereof and a driving method thereof, which are intended to solve the above technical problems of the related art.

The following describes the technical solution of the present disclosure and how to solve the above technical problems in detail by specific embodiments.

Figure 2:
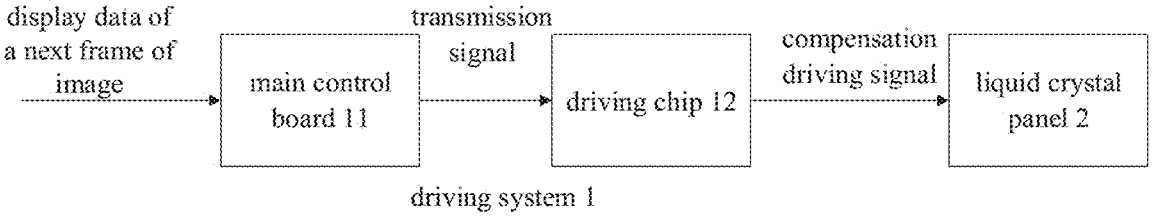
FIG. 2 is a schematic view of a frame structure of a driving system of an LCD device according to an embodiment of the present disclosure.
Figure 3:
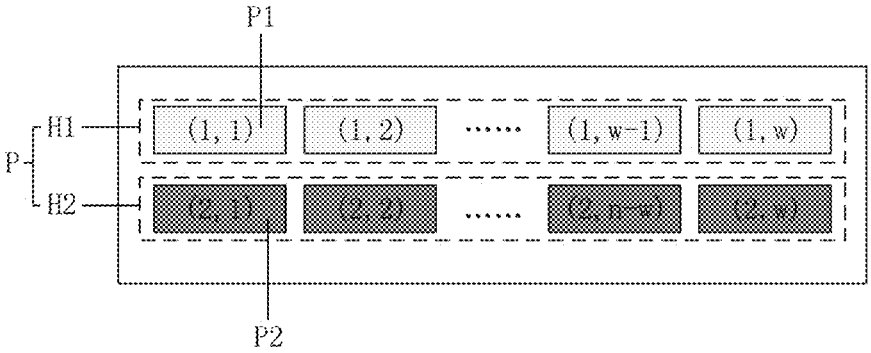
FIG. 3 is a schematic view of a specific graph provided by an embodiment of the present disclosure.

As shown in FIG. 1, FIG. 2, and FIG. 3, the driving system 1 provided in this embodiment includes a main control board 11 and a driving chip 12.

The main control board 11 is configured to receive display data of a next frame of image, and determine whether the next frame of image includes a specific graph P according to gray scale information of each pixel in the next frame of image included in the display data, where the specific graph P includes a first pixel section H1 and a second pixel section H2 located in adjacent pixel rows, the first pixel section H1 includes a plurality of consecutive first pixels P1 in a first gray scale, the second pixel section H2 includes a plurality of consecutive second pixels P2 in a second gray scale and located in the same pixel column as the first pixel section H2, and a difference value between the first gray scale and the second gray scale is greater than or equal to a first threshold; if the next frame of image includes the specific graph P, determining information to be compensated according to the positions of the first pixel section H1 and the second pixel section H2, the quantity of the first pixels P1 or the quantity of the second pixels P2, and the difference between the first gray scale and the second gray scale, where the information to be compensated includes the position of the region 40 to be compensated and the compensation level of the region 40 to be compensated, embedding the information to be compensated into a transmission signal for transmitting display data, and sending the transmission signal to the driving chip 12.

The driving chip 12 is configured to receive the transmission signal, decode the transmission signal to obtain information to be compensated, and generate a compensated driving voltage according to the position of the region 40 to be compensated, the compensation level of the region 40 to be compensated, and gray scale information of each pixel in the area to be compensated, where the compensated driving voltage is configured to drive the pixel in the region 40 to be compensated in the liquid crystal panel 2.

The gray scale information of the pixel includes luminance information of the red sub-pixel, the green sub-pixel, and the blue sub-pixel, that is, RGB information.

In the specific graph P, the quantity of pixels having a small number is used as the evaluation criterion of the compensation information in the first pixel P1 and the second pixel P2. For example, in the screen in FIG. 1, the quantity of pixels displaying white is small in the row direction, and the quantity of pixels displaying white is used as an evaluation criterion of the compensation information.

It should be noted that, the deviation of Vcom is different due to the difference between the first gray level and the second gray level and/or the quantity of the first pixels P1 or the second pixels P2 in the specific graph P, specifically, the quantity of the first pixels exceeds ⅛ of the total number of pixels in the pixel row, and the Vcom fluctuates significantly when the transition between the first gray level and the second gray level exceeds 80 gray levels. Specifically, as shown in FIG. 3, for example, in a specific graph P, the first pixel section H1 and the second pixel section H2 each include w pixels, w first pixels P1 and w second pixels P2 are respectively located in the first to w th columns, and w is a positive integer. The minimum value of w varies due to differences in the size, resolution, etc. of the display screen, and typically w is not less than 10% of the total number of pixels in a row of pixels.

The specific position and the luminance change of the specific region 30 can be obtained through conventional experience and experiments, so that the compensation data can be determined from the display data, and the compensation driving signal can be obtained from the display data and the compensation data.

It should be noted that, taking the picture shown in FIG. 1 as an example, the area to be compensated 40 may be a part of the specific area 30, and the specific area 30 includes a plurality of areas to be compensated 40, that is, the specific area 30 is compensated in a partitioned manner; of course, the specific area 30 may be compensated entirely, and in this case, the area to be compensated 40 is the same as the specific area 30.

The driving system 1 of the liquid crystal display device provided in this embodiment detects the display data, and when it is detected that the next frame of image includes a specific graph, that is, the specific region in the next frame of image can generate Vcom deviating from the normal value, compensates the original driving voltage, that is, the data voltage, of the specific region 30 to generate the compensated driving voltage, so that the electric field generated by the compensated driving voltage and the deviated Vcom can still control the liquid crystal molecules to deflect at an expected angle, thereby avoiding the deviation of the brightness of the pixels of the specific region 30, and improving the display effect of the LCD product.

Figure 4:
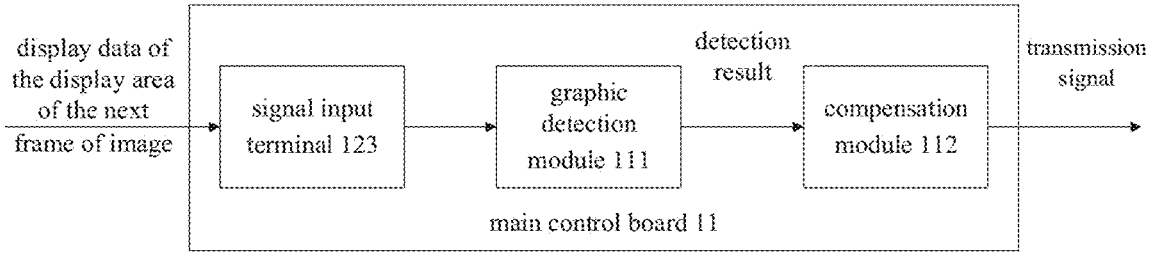
FIG. 4 is a schematic view of a frame structure of a main control board according to an embodiment of the present disclosure.

Further, the next frame of image includes s display areas, s being an integer greater than or equal to 2; as shown in FIG. 4, in the driving system 1 provided in the present embodiment, the main control board 11 further includes a signal input terminal 123, and the signal input terminal 123 is configured to receive the display data of the next frame in s steps, and each step receives the display data of one display area of the next frame.

For the large-sized liquid crystal panel 2, the main control board 11 usually receives the display data of the next frame in different regions, so as to avoid the excessive data amount processed by the driving system 1 at the same time, so as to reduce the load of the driving system 1.

Further, as shown in FIG. 2 to FIG. 4, in the driving system 1 of the liquid crystal display device provided in the present embodiment, the main control board 11 includes a graphic detection module 111 and a compensation module 112.

The graphic detection module 111 is configured to determine whether the next frame image includes a specific image P according to gray scale information of pixels in the next frame image included in the display data, the specific image P includes a first pixel section H1 and a second pixel section H2 located in adjacent pixel rows, the first pixel section H1 includes a plurality of first pixels P1 which are consecutive in a first gray scale, the second pixel section H2 includes a plurality of second pixels P2 which are consecutive in a second gray scale and located in the same pixel column as the first pixel section H2, and a difference between the first gray scale and the second gray scale is greater than or equal to a first threshold.

The compensation module 112 is configured to determine information to be compensated according to the positions of the first pixel section H1 and the second pixel section H2, the quantity of the first pixels P1 or the quantity of the second pixels P2, and the difference between the first gray scale and the second gray scale if the next frame includes the specific graphic P, where the information to be compensated includes the position of the region 40 to be compensated and the compensation level of the region 40 to be compensated, embed the information to be compensated into a transmission signal for transmitting display data, and send the transmission signal to the driving chip 12.

Figure 5:
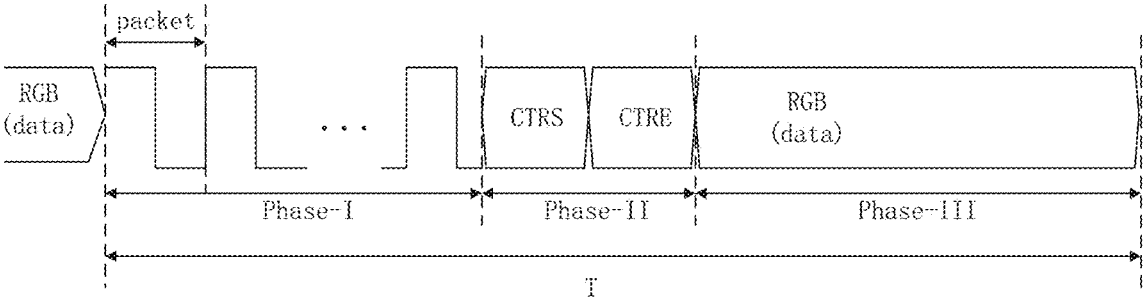
FIG. 5 is a schematic view of a CEDS-based transmission signal according to an embodiment of the present disclosure.
Figure 6:
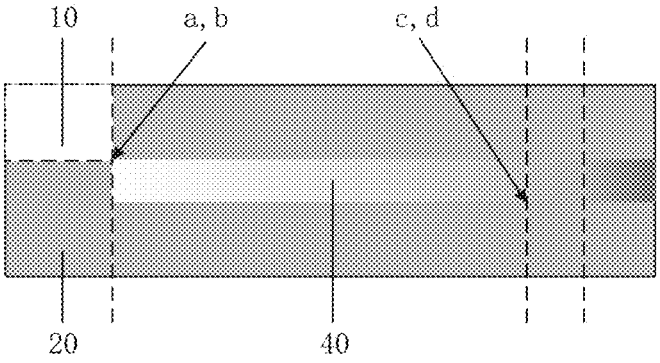
FIG. 6 is a schematic view showing a partial enlargement of the region M in the frame shown in FIG. 1.

Specifically, as shown in FIG. 4 to FIG. 6, the main control board 11 and the driver chip 12 are implemented by a p2p (point-to-point) manner, taking transmission based on the CED (Clock Embedded Differential Signal) protocol as an example, transmission of a CED Signal in each period T is generally divided into a first Phase-I, a second Phase-II and a third Phase-III, and normally, multiple packets (packets) transmitted by the Signal in the first Phase-I are not used, so that compensation data can be Embedded into the first Phase-I as a packet, and then the CED is expanded, thereby implementing transmission of the compensation data and display data based on the CED protocol.

In addition, since the conventional transmission protocol is usually scalable, in practical disclosures, the compensation data may be embedded in a signal based on a protocol such as USIT, CHPI, CVS, or the like to realize transmission of the compensation data from the main control board 11 to the driver chip 12.

Further, as shown in FIG. 1 and FIG. 4, in the driving system 1 provided in the present embodiment, the compensation module 112 is specifically configured to utilize a preset compensation model to determine the information to be compensated according to the positions of the first pixel section 10 and the second pixel section 20, the quantity of the first pixel P1 or the quantity of the second pixel section P2, and the difference between the first gray scale and the second gray scale.

Specifically, the more serious the Vcom deviates from the normal value, the higher the compensation level, the preset compensation model is set by the detection data for the specific graph shown in FIG. 1 and the common ruled pattern, the information of the area to be compensated may be determined by obtaining the position of the specific graph P, and the compensation level may be obtained by looking up a table through a gray-scale difference value.

Figure 7:
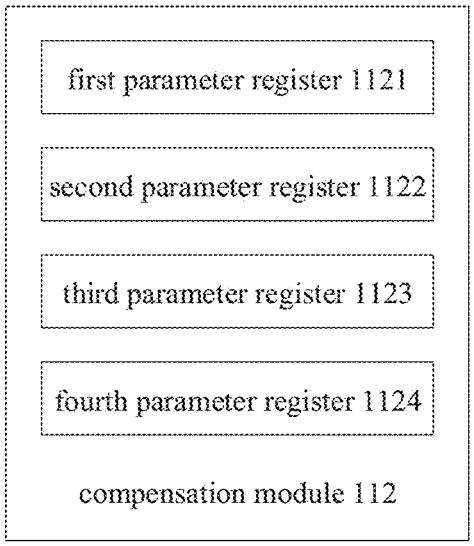
FIG. 7 is a schematic view of a frame structure of a compensation module according to an embodiment of the present disclosure.

Alternatively, as shown in FIGS. 6 and 7, the present embodiment provides the driving system 1 in which the display data includes grayscale information of k pixels; the compensation module includes: a first parameter register 1121 configured to encode a pixel of a start position of the area to be compensated 40; a second parameter register 1122 configured to encode pixels of the termination position of the area to be compensated 40; a third parameter register 1123 configured to encode a compensation level of the pixel of the start position; a fourth parameter register 1124 configured to encode the compensation level of the pixel at the termination position; the first parameter register 1121 and the second parameter register 1122 are both n-bit registers, and $2^n$ is more than or equal to k; the third parameter register 1123 and the fourth parameter register 1124 are m-bit registers, and $a2^m$ is equal to the adjustment range of the compensation voltage, where m, n, and k are integers greater than or equal to 1, and a is the adjustment amplitude.

Specifically, as shown in FIG. 6, taking one compensation area 40 as an example, the start position is a parameter a, the starting compensation level is a parameter b, the end position is a parameter c, and the ending compensation level is a parameter d.

Specifically, in a large-sized LCD device, each frame of picture is divided into a plurality of regions, each region includes 960 pixels, and at this time, the first parameter register 1121 and the second parameter register 1122 in the compensation module 112 should be 10-bit registers, and thus, the first parameter register 1121 and the second parameter register 1122 should be 10-bit registers, which can cover 210, namely 1024 signal channels (channels), that is, each pixel can correspond to one channel, so as to encode any one of the above pixels.

As shown in table 1, the start position and the end position are packed into a 28-bit data packet, that is, packet1, where the 0th bit to the first bit in packet1 are packet headers, the 26th bit to the 27th bit are packet trailers, the start position occupies the second byte to the 11th byte, the end position occupies the 12th bit to the 21st bit, and the 2 second bit to the 25th bit are reserved bytes.

TABLE 1

Compensation information Table

| bit | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 |
|---|---|---|---|---|---|---|---|---|---|---|---|---|---|---|---|---|---|---|---|---|---|---|---|---|---|---|---|---|
| packer1 | 1 | 1 | Start position | | | | | | | | | | | | | End position | | | | | | | | reserved | | | 0 | 0 |
| packer2 | 1 | 1 | starting compensation level | | | | ending compensation level | | | | | | | | | reserved | | | | | | | | | | | 0 | 0 |

The starting compensation level in table 1 is the compensation level of the pixel at the start position, and the ending compensation level is the compensation level of the pixel at the end position. As shown in table 1, the starting compensation level and the ending compensation level are packed into a 28-bit data packet, that is, packet2, where the 0th bit to the first bit in packet2 are packet headers, the 26th bit to the 27th bit are packet trailers, the start position occupies the second bit to the 5th bit, the end position occupies the 6th bit to the 9th bit, and the 10th bit to the 25th bit are reserved bytes.

Specifically, the Vcom deviation is related to the voltage value of the data signal, and in the liquid crystal panel, the voltage value of the data signal has a certain range, so that the voltage range of Vcom deviation is within a certain range. Based on this, the adjustment range of the compensation voltage is determined according to the voltage range of Vcom deviation. For example, the maximum value of Vcom shift is about 300 mV, the adjustment range of compensation voltage can be set to 320 mV, the compensation level has 24 steps, i.e. 16 steps, and the adjustment amplitude a is 20 mV.

In practical implementation, the quantity of bytes per packet may be set, or the remaining number of bytes may be applied to encoding, so as to adapt to more lcd devices.

Figure 8:
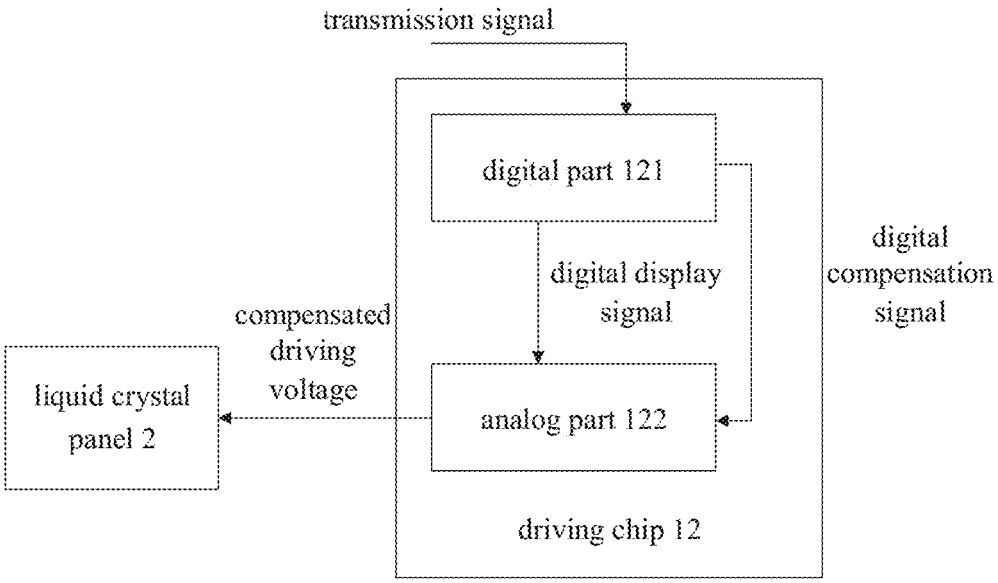
FIG. 8 is a schematic view of a frame structure of a driver chip according to an embodiment of the present disclosure.

Alternatively, as shown in FIG. 8, in the driving system 1 provided in the present embodiment, the driving chip 12 includes a digital part 121 and an analog part 122; the digital part 121 is configured to receive the transmission signal, decode the transmission signal to obtain information to be compensated, generate a digital display signal according to the start position, the end position, the compensation level of the start position and the compensation level of the end position, and generate a digital display signal according to gray scale information of each pixel in the area to be compensated 40 in the display data; the analog part 122 is configured to convert the digital compensation signal into a compensation voltage in an analog form, convert the digital display signal into an original driving voltage in an analog form, and adjust the original driving voltage of the corresponding pixel according to the compensation voltage of each pixel to determine a compensated driving voltage of each pixel within the area to be compensated 40.

Specifically, taking a certain compensation as an example, the region 40 to be compensated includes x rows and y columns of pixels, a pixel at a start position is a pixel at a first row and a first column in the region 40 to be compensated, and a pixel at an end position is a pixel at an x th row and a y-th column in the area to be compensated. The digital part 121 generates a digital compensation signal in the following manner: obtaining the compensation level of the pixel of the first column of each row according to the compensation level of the start position according to a set first function, obtaining the compensation level of the pixel of the y-th column of each row according to the compensation level of the end position according to a set second function, and calculating the compensation level of the pixel of the second column to the y-1st column of each row by adopting an interpolation method; a digital compensation signal for each pixel is generated based on the compensation level for each pixel within the area to be compensated 40.

Specifically, the Vcom deviation of the specific area 30 is different because different positions of the common electrode are affected by different data voltages, and in general, the Vcom deviation is more serious at the boundary of the first pixel section 10 and the second pixel section 20. Therefore, the compensation level of the pixels in each row in the compensation region 40 is calculated by interpolation, and the obtained compensation level is relatively consistent with the real compensation level of the corresponding pixel.

Figure 11:
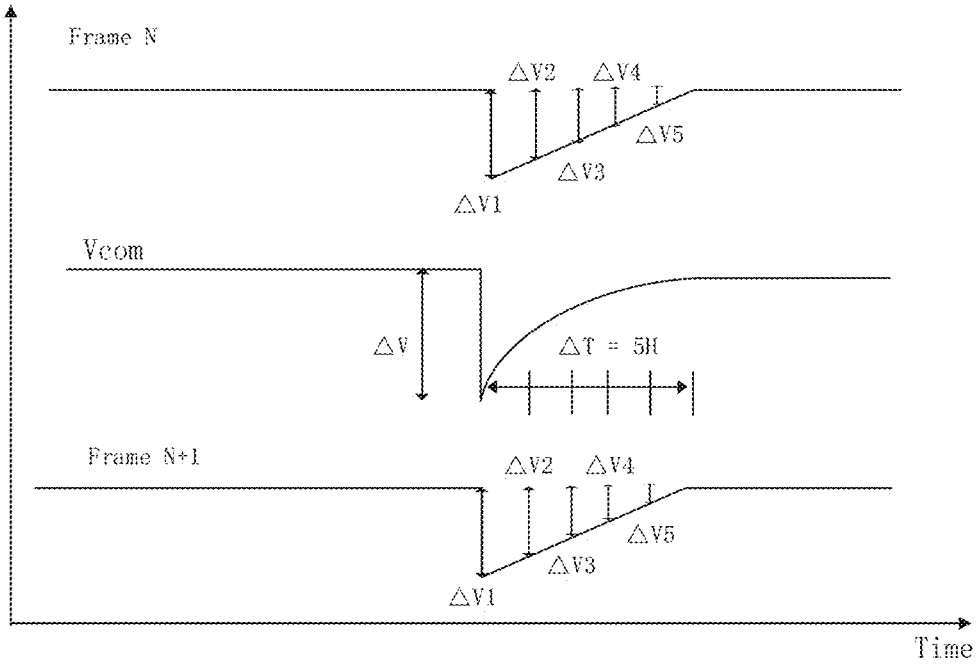
FIG. 11 is a schematic view illustrating positive and negative frame voltages and a common voltage included in a compensation driving signal according to an embodiment of the present disclosure.

Specifically, as shown in FIG. 11, since the deviation of the common voltage Vcom is gradually reduced after the voltage deviation until the common voltage Vcom is restored to the normal value, the compensation level from the first row to the y-th row at the start position and the compensation level at the end position should be gradually reduced.

Figure 10:
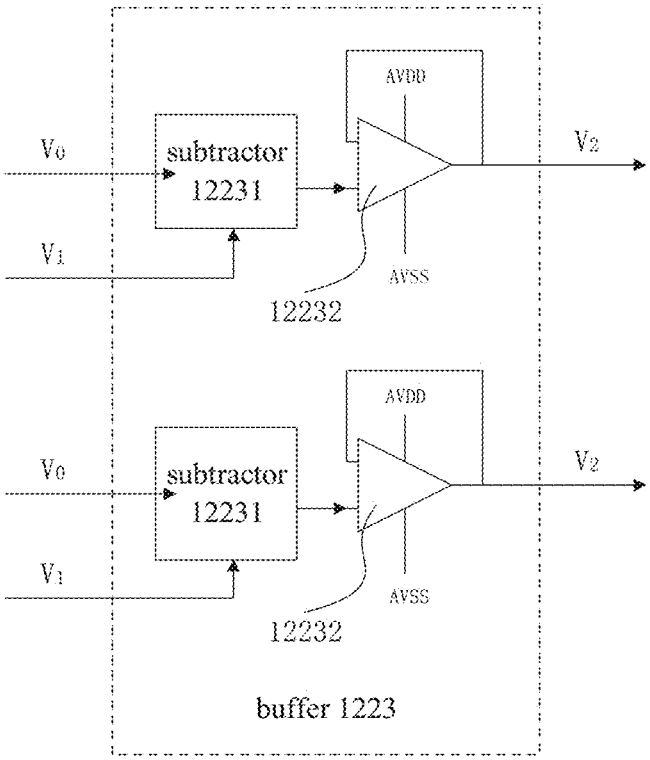
FIG. 10 is a schematic structural diagram of a buffer of an analog part in a driver chip according to an embodiment of the present disclosure.

Specifically, the positive and negative Frame voltages are Frame N and Frame N+1 as shown in FIG. 10, respectively.

In a liquid crystal panel, Vcom is pulled down by ΔV under the influence of data voltage, and Vcom pulled down will return to normal value within 5H, where 5H is the display time of 5 rows of pixels. In this process, the pulled-down Vcom is gradually increased, and in order to ensure that the positive and negative Frame voltages Frame N and Frame N+1 of the compensation driving signal are symmetrical with respect to Vcom to realize normal display, it is necessary to separately determine the compensation level for each 1H display period, that is, to separately compensate for each row of pixels in the area to be compensated 40.

Specifically, for convenience of calculation, the compensation levels of the positive and negative Frame voltages Frame N and Frame N+1 of the compensation driving signal are fitted to linear functions, that is, both the first function and the second function are linear functions. For example, as shown in FIG. 11, in the 5H period when Vcom is pulled down to be restored, the compensation voltages of the positive and negative Frame voltages Frame N and Frame N+1 of the pixels in the first row to the 5th row in the area to be compensated 40 are respectively: the change rules of ΔV1, ΔV2, ΔV3, ΔV4 and ΔV5, and the change rules of ΔV1, ΔV2, ΔV3, ΔV4 and ΔV5 conform to linear functions.

Figure 9:
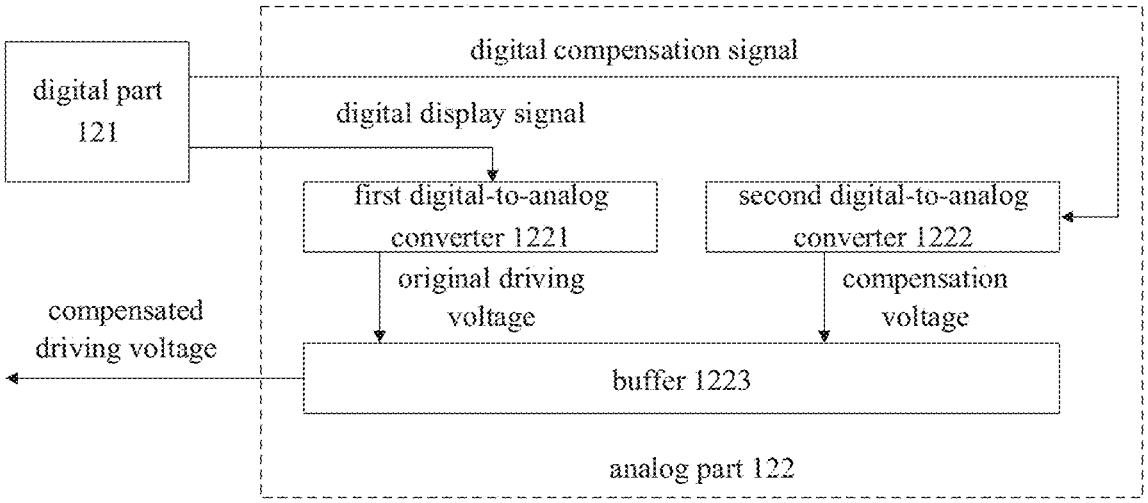
FIG. 9 is a schematic view of a frame junction of an analog part of a driver chip according to an embodiment of the present disclosure.

Further, as shown in FIGS. 9 and 10, the present embodiment provides the driving system 1 in which the analog part 122 includes:

a first digital-to-analog converter 1221 electrically connected to the digital part 121 and configured to convert the digital display signal into an original driving voltage of each pixel in an analog form;

a second digital-to-analog converter 1222 electrically connected to the digital part 121 and configured to convert the digital compensation signal into a compensation voltage of each pixel in an analog form;

and a buffer 1223 including a plurality of subtractors 12231 and a plurality of amplifiers 12232, each subtractor 12231 being electrically connected to one amplifier 12232, each subtractor 12231 adjusting an original driving voltage of a corresponding pixel according to the compensation voltage of the pixel to generate a voltage to be amplified, and the amplifier 12232 amplifying the voltage to be amplified to generate a compensated driving voltage of the pixel.

Specifically, in the buffer 1223 shown in FIG. 10, V0 refers to the original driving voltage, V1 refers to the compensated voltage, V2 refers to the compensated driving voltage, AVDD is the reference high level, and AVSS is the reference low level.

Specifically, for the non-to-be-compensated region, since compensation is not required, bytes used for encoding compensation positions and compensation levels in packets 1 and 2 in the transmission signal can be both set to 0, so that the compensation voltage is 0, and the output compensated driving voltage is equal to the original driving voltage; or the compensation information is not embedded into the transmission signal, at this time, the compensation voltage is suspended, and the output compensated driving voltage is equal to the original driving voltage.

It should be noted that the second DAC 1222 may also be integrated into the subtractor 12231.

The present embodiment can realize the operation of the compensation voltage and the original driving voltage by adding the subtractor 12231 to the buffer unit, thereby obtaining the compensation driving signal.

Figure 12:
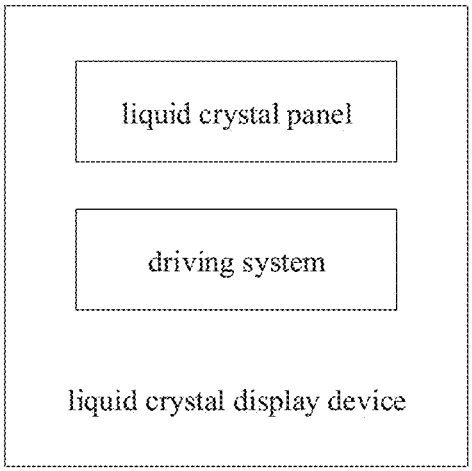
FIG. 12 is a schematic view of a frame structure of an LCD device according to an embodiment of the present disclosure.

As shown in FIG. 12, the liquid crystal display device provided in this embodiment includes a driving system 1.

Further, the liquid crystal display device provided by the present embodiment further includes a liquid crystal panel 2, and the liquid crystal panel 2 is electrically connected to the driving chip 12 in the above embodiment.

Optionally, the driving system 1 includes:

The main control board is configured to receive display data of a next frame of image, and determine whether the next frame of image includes a specific figure according to gray scale information of each pixel in the next frame of image, where the specific figure includes a first pixel section and a second pixel section which are positioned in adjacent pixel rows, the first pixel section includes a plurality of continuous first gray scales, the second pixel section includes a plurality of continuous second gray scales, the second pixel section is positioned in the same pixel row as the first pixel section, and a difference value between the first gray scales and the second gray scales is larger than or equal to a first threshold value; if the next frame of image includes the specific graph, determining information to be compensated according to the positions of the first pixel section and the second pixel section, the quantity of the first pixels or the quantity of the second pixels and the difference value between the first gray scale and the second gray scale, where the information to be compensated includes the position of an area to be compensated and the compensation level of the area to be compensated; embedding the information to be compensated into a transmission signal for transmitting the display data, and sending the transmission signal to a driving chip;

the driving chip is configured to receive the transmission signal, decode the transmission signal to obtain the information to be compensated and the display data, and generate a compensated driving voltage according to the position of the area to be compensated, the compensation level of the area to be compensated, and the gray scale information of each pixel in the area to be compensated, where the compensated driving voltage is configured to drive the pixel in the area to be compensated in the liquid crystal panel.

Optionally, the main control board includes a graphic detection module and a compensation module;

the graphic detection module is configured to determine whether the next frame of image includes a specific image according to gray scale information of each pixel in the next frame of image included in the display data, the specific image includes a first pixel section and a second pixel section located in adjacent pixel rows, the first pixel section includes a plurality of first pixels which are continuous in a first gray scale, the second pixel section includes a plurality of second pixels which are continuous in a second gray scale and located in the same pixel column as the first pixel section, and a difference value between the first gray scale and the second gray scale is greater than or equal to a first threshold;

the compensation module is configured to determine information to be compensated according to positions of the first pixel section and the second pixel section, the quantity of the first pixels or the quantity of the second pixels, and a difference value between the first gray scale and the second gray scale if the next frame includes the specific graph, where the information to be compensated includes a position of a area to be compensated and a compensation level of the area to be compensated, embed the information to be compensated into a transmission signal for transmitting display data, and send the transmission signal to a driving chip.

Optionally, the display data includes grayscale information of k of the pixels; the compensation module includes:

a first parameter register configured to encode a pixel of a start position of the area to be compensated;

a second parameter register configured to encode a pixel of an end position of the area to be compensated;

a third parameter register configured to encode a compensation level of a pixel of the start position;

a fourth parameter register configured to encode a compensation level of a pixel of the termination location;

the first parameter register and the second parameter register are both n-bit registers, and 2n is more than or equal to k; the third parameter register and the fourth parameter register are m-bit registers, a2m is equal to the adjustment range of the compensation voltage, m, n and k are integers greater than or equal to 1, and a is the adjustment amplitude.

Optionally, the driving chip includes:

a digital part configured to receive the transmission signal, decode the transmission signal to obtain the information to be compensated and the display data, and generate a digital display signal according to the start position, the end position, the compensation level of the start position and the compensation level digital compensation signal of the end position, and gray scale information of each pixel in the compensation area in the display data;

an analog part configured to convert the digital compensation signal into a compensation voltage in an analog form, convert the digital display signal into an original driving voltage in an analog form, and adjust the original driving voltage of the corresponding pixel according to the compensation voltage of each pixel to determine a compensated driving voltage of each of the pixels within the compensation region.

Optionally, the analog part includes:

a first digital-to-analog converter electrically connected to the digital part and configured to convert the digital display signal into an original driving voltage of each of the pixels in an analog form;

a second digital-to-analog converter electrically connected to the digital part and configured to convert the digital compensation signal into a compensation voltage of each of the pixels in an analog form;

and the buffer includes a plurality of subtractors and a plurality of amplifiers, each subtractor is electrically connected with one amplifier, each subtractor adjusts the original driving voltage of the corresponding pixel according to the compensation voltage of one pixel to generate a voltage to be amplified, and the amplifiers amplify the voltage to be amplified to generate a compensated driving voltage of the pixel.

Optionally, the next frame of image includes s display regions, where s is an integer greater than or equal to 2;

the main control board further includes a signal input end, where the signal input end is configured to receive the display data of the next frame of image in s steps, and each step receives the display data of one display area of the next frame of image.

As shown in FIG. 1, FIG. 2, FIG. 3, and FIG. 13, the driving method of the liquid crystal display device provided in this embodiment includes:

s1: receiving display data of a next frame of image, where the display data includes gray scale information of each pixel in the next frame of image;

s2: determining whether a next frame of image includes a specific graph P according to the gray scale information of each pixel, where the specific graph P includes a first pixel section H1 and a second pixel section H2 which are positioned on adjacent pixel rows, the first pixel section H1 includes a plurality of continuous first gray scales P1, the second pixel section H2 includes a plurality of continuous second gray scales P2 which are positioned on the same pixel row as the first pixel section H2, and the difference value between the first gray scales and the second gray scales is larger than or equal to a first threshold value;

s3: if the next frame includes the specific graph P, determining the information to be compensated according to the positions of the first pixel section 10 and the second pixel section 20, the quantity of the first pixels P1 or the quantity of the second pixels P2, and the difference between the first gray scale and the second gray scale, where the information to be compensated includes the position of the region 40 to be compensated and the compensation level of the region 40 to be compensated;

s4: generating a compensated driving voltage according to the position of the area to be compensated 40, the compensation level of the area to be compensated 40 and the gray scale information of each pixel in the area to be compensated, where the compensated driving voltage is configured to drive the pixel of the area to be compensated 40 in the liquid crystal panel.

In the driving method of the liquid crystal display device provided by the embodiment, by detecting the display data, when it is detected that the next frame of image includes a specific graph, that is, Vcom is generated in the next frame of image to deviate from a normal value, the original driving voltage, that is, the data voltage, of the specific region 30 is compensated to generate a compensated driving voltage, so that an electric field generated by the compensated driving voltage and the deviated Vcom can still control liquid crystal molecules to deflect at an expected angle, thereby avoiding brightness deviation of pixels of the specific region 30, and improving the display effect of an LCD product.

Optionally, the next frame of image includes s display regions, s being an integer greater than or equal to 2; in the driving method provided in this embodiment, step S1 includes: the method includes the steps of receiving display data of a next frame of image in s steps, and receiving display data of a display area of the next frame of image in each step.

For the large-sized liquid crystal panel 2, the main control board 11 usually receives the display data of the next frame in different regions, so as to avoid the excessive data amount processed by the driving system 1 at the same time, so as to reduce the load of the driving system 1.

Further, in the driving method provided in this embodiment, the display data includes grayscale information of k pixels, and step S2 includes: and determining information to be compensated according to the positions of the first pixel section 10 and the second pixel section 20, the quantity of the first pixels P1 and the quantity of the second pixels P2, and the difference value between the first gray scale and the second gray scale by using a preset compensation model.

It should be noted that, the deviation of Vcom is different due to the difference between the first pixel P1 and the second pixel P2 and/or the difference between the first gray level and the second gray level in the specific graph P, specifically, the Vcom is obviously fluctuated when the quantity of the first pixels exceeds ⅛ of the total number of pixels in the pixel row and the transition between the first gray level and the second gray level exceeds 80 gray levels. Specifically, as shown in FIG. 3, for example, in a specific graph P, the first pixel section H1 and the second pixel section H2 each include w pixels, w first pixels P1 and w second pixels P2 are respectively located in the first to w th columns, and w is a positive integer. The minimum value of w varies due to differences in the size, resolution, etc. of the display screen, and typically w is not less than 10% of the total number of pixels in a row of pixels.

The specific position and the luminance change of the specific region 30 can be obtained through conventional experience and experiments, so that the compensation data can be determined from the display data, and the compensation driving signal can be obtained from the display data and the compensation data.

Optionally, the liquid crystal display device further includes a driving system electrically connected to the liquid crystal panel, where the driving system includes a main control board 11 and a driving chip 12, and based on this, the driving method provided in this embodiment further includes: after determining the information to be compensated, the main control board 11 embeds the information to be compensated into a transmission signal for transmitting display data, and sends the transmission signal to the driving chip 12; the driving chip 12 receives the transmission signal, decodes the transmission signal to obtain information to be compensated, and then generates a compensated driving voltage according to the position of the region 40 to be compensated, the compensation level of the region 40 to be compensated, and the gray scale information of each pixel in the region 40 to be compensated.

Specifically, please refer to the description of the related contents in the above driving system regarding how to embed the information to be compensated into the transmission signal for transmitting the display data, which is not described herein again.

Further, the next frame of image includes S display areas, S is an integer greater than or equal to 2, based on which, in the driving method provided in this embodiment, step S1 includes: and the display data of the next frame of image is received in s steps, and the display data of one display area of the next frame of image is received in each step.

For the large-sized liquid crystal panel 2, the main control board 11 usually receives the display data of the next frame in different regions, so as to avoid the excessive data amount processed by the driving system 1 at the same time, so as to reduce the load of the driving system 1.

Figure 13:
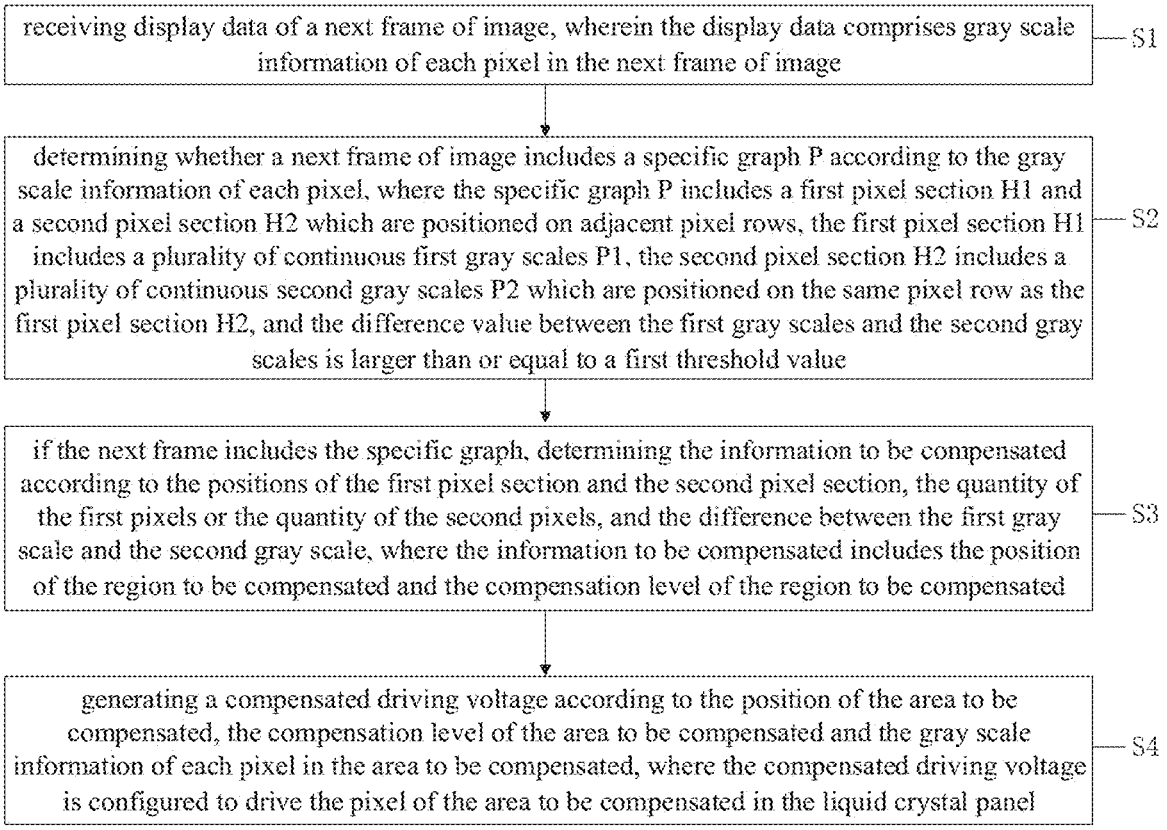
FIG. 13 is a schematic flowchart illustrating a driving method of an LCD device according to an embodiment of the present disclosure.
Figure 14:
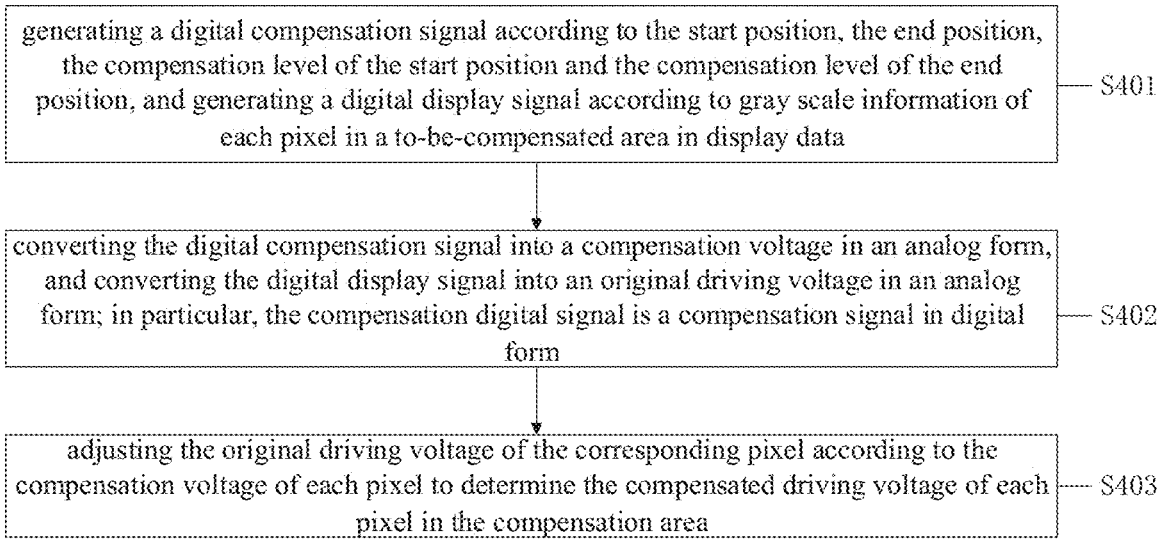
FIG. 14 is a flowchart illustrating step S4 of the method for driving the LCD device shown in FIG. 13.

Further, as shown in FIG. 13, in the driving method provided in this embodiment, step S4 includes:

S401: generating a digital compensation signal according to the start position, the end position, the compensation level of the start position and the compensation level of the end position, and generating a digital display signal according to gray scale information of each pixel in a to-be-compensated area in display data; specifically, the digital display signal is a display signal in a digital form.

S402: converting the digital compensation signal into a compensation voltage in an analog form, and converting the digital display signal into an original driving voltage in an analog form; in particular, the compensation digital signal is a compensation signal in digital form.

S403: adjusting the original driving voltage of the corresponding pixel according to the compensation voltage of each pixel to determine the compensated driving voltage of each pixel in the compensation area.

Specifically, taking a certain compensation as an example, the area to be compensated includes x rows and y columns of pixels, a pixel at a start position is a pixel at a first row and a first column in the area to be compensated 40, and a pixel at an end position is a pixel at an x th row and a y-th column in the area to be compensated 40. The digital compensation signal is generated in the following way: obtaining the compensation level of the pixel of the first column of each row according to the compensation level of the start position according to a set first function, obtaining the compensation level of the pixel of the y-th column of each row according to the compensation level of the end position according to a set second function, and calculating the compensation level of the pixel of the second column to the y-1st column of each row by adopting an interpolation method; a digital compensation signal for each pixel is generated based on the compensation level for each pixel within the area to be compensated 40.

Specifically, the Vcom deviation of the specific area 30 is different because different positions of the common electrode are affected by different data voltages, and in general, the Vcom deviation is more serious at the boundary of the first pixel section 10 and the second pixel section 20. Therefore, the compensation level of the pixels in each row in the compensation region 40 is calculated by interpolation, and the obtained compensation level is relatively consistent with the real compensation level of the corresponding pixel.

Specifically, as shown in FIG. 10, since the deviation of the common voltage Vcom is gradually reduced after the voltage deviation until the common voltage Vcom is restored to the normal value, the compensation level from the first row to the y-th row at the start position and the compensation level at the end position should be gradually reduced.

The compensation voltage of each row of pixels in the region 40 to be compensated is calculated by interpolation, and the calculation method is simple. Specifically, please refer to FIG. 11 and the related description in the embodiment of the driving system, and details thereof are not repeated herein for a specific example of the compensated positive and negative frame voltages and the off-state Vcom.

By applying the embodiment of the disclosure, the following beneficial effects can be at least realized:

according to the liquid crystal display device, the driving system and the driving method thereof provided by the embodiment of the disclosure, through detecting the display data, when the next frame of image includes a specific graph, namely, when the Vcom generated by a specific area in the next frame of image deviates from a normal value, the original driving voltage, namely the data voltage, of the specific area is compensated to generate the compensated driving voltage, so that the electric field generated by the compensated driving voltage and the deviated Vcom can still control the liquid crystal molecules to deflect at an expected angle, the deviation of the brightness of pixels in the specific area is avoided, and the display effect of an LCD product is improved.

Those of skill in the art will understand that various operations, methods, steps in the flow, measures, schemes discussed in this disclosure can be alternated, modified, combined, or deleted. Further, various operations, methods, steps, measures, schemes in the various processes, methods, procedures that have been discussed in this disclosure may be alternated, modified, rearranged, decomposed, combined, or eliminated. Further, steps, measures, schemes in various operations, methods, procedures disclosed in the related art and the present disclosure may also be alternated, changed, rearranged, decomposed, combined, or deleted.

In the description of the present disclosure, it is to be understood that the terms "center", "upper", "lower", "front", "rear", "left", "right", "vertical", "horizontal", "top", "bottom", "inner", "outer", and the like indicate orientations or positional relationships based on those shown in the drawings, merely for convenience of description and simplicity of description, and do not indicate or imply that the devices or elements referred to must have a particular orientation, be constructed in a particular orientation, and be operated, and thus, are not to be construed as limiting the present disclosure.

The terms "first", "second" and "first" are used for descriptive purposes only and are not to be construed as indicating or implying relative importance or to implicitly indicate the quantity of technical features indicated. Thus, a feature defined as "first" or "second" may explicitly or implicitly include one or more of that feature. In the description of the present disclosure, the meaning of "a plurality" is two or more unless otherwise specified.

In the description of the present disclosure, it should be noted that, unless otherwise explicitly stated or limited, the terms "mounted," "connected," and "connected" are to be construed broadly, and may be, for example, a fixed connection, a detachable connection, or an integral connection; they may be connected directly or indirectly through intervening media, or they may be interconnected between two elements. The specific meaning of the above terms in this disclosure will be understood to be a specific case for those of ordinary skill in the art.

The particular features, structures, materials, or characteristics may be combined in any suitable manner in any one or more embodiments or examples.

It should be understood that, although the steps in the flowcharts of the figures are shown in order as indicated by the arrows, the steps are not necessarily performed in order as indicated by the arrows. The steps are not performed in the exact order shown and may be performed in other orders unless otherwise indicated herein. Moreover, at least a portion of the steps in the flow chart of the figure may include multiple sub-steps or multiple stages, which are not necessarily performed at the same time, but may be performed at different times, and the order of execution is not necessarily sequential, but may be performed alternately or alternately with other steps or at least a portion of the sub-steps or stages of other steps.

The foregoing is only a few embodiments of the present disclosure and it should be noted that those skilled in the art can make various improvements and modifications without departing from the principle of the present disclosure, and that these improvements and modifications should also be considered as the protection scope of the present disclosure.

What is claimed is:

1. A driving method of a liquid crystal display device, wherein the liquid crystal display device comprises a liquid crystal panel, and the driving method comprises:

receiving display data of a next frame of image, wherein the display data comprises gray scale information of each pixel in the next frame of image;

determining whether the next frame of image comprises a specific graph according to the gray scale information of each pixel, wherein the specific graph comprises a first pixel section and a second pixel section which are positioned in adjacent pixel rows, the first pixel section comprises a plurality of continuous first pixels with first gray scales, the second pixel section comprises a plurality of continuous second pixels which are with second gray scales and positioned in the same pixel row with the first pixel sections, and a difference value between the first gray scales and the second gray scales is larger than or equal to a first threshold value;

if the next frame of image comprises the specific graph, determining information to be compensated according to positions of the first pixel section and the second pixel section, a quantity of the first pixels or a quantity of the second pixels and the difference value between the first gray scale and the second gray scale, wherein the information to be compensated comprises a position of an area to be compensated and a compensation level of the area to be compensated; and generating a compensated driving voltage according to the position of the area to be compensated, the compensation level of the area to be compensated and the gray scale information of each pixel in the area to be compensated, wherein the compensated driving voltage is configured to drive the pixels in the area to be compensated in the liquid crystal panel.

2. The driving method according to claim 1, wherein the determining information to be compensated according to the positions of the first pixel section and the second pixel section, the quantity of the first pixels or the quantity of the second pixels and the difference between the first gray scale and the second gray scale comprises:

determining the information to be compensated according to the positions of the first pixel section and the second pixel section, the quantity of the first pixels or the quantity of the second pixels and the difference value between the first gray scale and the second gray scale by using a preset compensation model.

3. The driving method according to claim 1, wherein the liquid crystal display device further comprises a driving system electrically connected to the liquid crystal panel, the driving system comprises a main control board and a driving chip;

the driving method further comprises:

after the information to be compensated is determined, embedding, by the main control board, the information to be compensated into a transmission signal for transmitting display data and send the transmission signal to the driving chip; and the driving chip receiving the transmission signal, decoding the transmission signal to obtain the information to be compensated, and then generating the compensated driving voltage according to the position of the area to be compensated, the compensation level of the area to be compensated and the gray scale information of each pixel in the area to be compensated.

4. The driving method according to claim 3, wherein the display data comprises grayscale information of k pixels, and the embedding, by the main control board, the information to be compensated into the transmission signal for transmitting display data comprises:

encoding pixels at a start position and pixels at an end position of the area to be compensated to generate a first data packet, and transmitting the first data packet through the transmission signals;

encoding the compensation level of the pixels at the start position and the compensation level of the pixels at the end position to generate a second data packet, and transmitting the second data packet through the transmission signal;

wherein the pixels at the start position and the pixel at the end position are both represented by n-bit binary digits, and $2^n \geq k$; the compensation level of the start position and the compensation level of the end position are both represented by m-bit binary digits, and $a2^m$ is equal to an adjustment range of a compensation voltage, wherein m, n and k are integers greater than or equal to 1, and a is an adjustment amplitude.

5. The driving method according to claim 4, wherein the generating the compensated driving voltage according to the position of the area to be compensated, the compensation level of the area to be compensated and the gray scale information of each pixel in the area to be compensated comprises:

generating a digital compensation signal according to the start position, the end position, the compensation level of the start position and the compensation level of the end position, and generating a digital display signal according to gray scale information of each pixel in the area to be compensated in the display data;

converting the digital compensation signal into a compensation voltage in an analog form, and converting a digital display signal into an original driving voltage in an analog form; and adjusting the original driving voltage of the corresponding pixel according to the compensation voltage of each pixel, to determine the compensated driving voltage of each pixel in the compensation area.

6. The driving method according to claim 5, wherein the area to be compensated comprises x rows and y columns of pixels, the pixels at the start position are the pixels at a first row and a first column in the area to be compensated, and the pixels at the end position are the pixels at a x-th row and a y-th column in the area to be compensated; the generating the digital compensation signal according to the start position, the end position, the compensation level of the start position and the compensation level of the end position comprises:

obtaining the compensation level of the pixels at the first column of each row according to a set first function and the compensation level of the start position, obtaining the compensation level of the pixels of the y-th column of each row according to a set second function and the compensation level of the end position, and calculating the compensation level of the pixels of the second to the (y-1)-th columns of each row by using an interpolation method; and generating the digital compensation signal of each pixel according to the compensation level of each pixel in the area to be compensated.

7. The driving method according to claim 1, wherein the next frame of image comprises s display regions, s being an integer greater than or equal to 2, the receiving the display data of the next frame of image comprises:

receiving the display data of the next frame of image in s steps, and receiving the display data of the display area of the next frame of image in each step.

8. A driving system of a liquid crystal display device, comprising:

a main control board, configured to:

receive display data of a next frame of image, wherein the display data comprises gray scale information of each pixel in the next frame of image;

determine whether the next frame of image comprises a specific graph according to the gray scale information of each pixel, wherein the specific graph comprises a first pixel section and a second pixel section which are positioned in adjacent pixel rows, the first pixel section comprises a plurality of continuous first pixels with first gray scales, the second pixel section comprises a plurality of continuous second pixels which are with second gray scales and positioned in the same pixel row with the first pixel sections, and a difference value between the first gray scales and the second gray scales is larger than or equal to a first threshold value;

if the next frame of image comprises the specific graph, determine information to be compensated according to positions of the first pixel section and the second pixel section, a quantity of the first pixels or a quantity of the second pixels and the difference value between the first gray scale and the second gray scale, wherein the information to be compensated comprises a position of an area to be compensated and a compensation level of the area to be compensated; embed the information to be compensated into a transmission signal for transmitting the display data, and send the transmission signal to a driving chip;

a driving chip is configured to receive the transmission signal, decode the transmission signal to obtain the information to be compensated and the display data, and generate a compensated driving voltage according to the position of the area to be compensated, the compensation level of the area to be compensated, and the gray scale information of each pixel in the area to be compensated, wherein the compensated driving voltage is configured to drive the pixel in the area to be compensated in the liquid crystal panel.

9. The driving system according to claim 8, wherein the main control board comprises a graphic detection module and a compensation module;

the graphic detection module is configured to determine whether the next frame of image comprises a specific graph according to the gray scale information of each pixel, wherein the specific graph comprises a first pixel section and a second pixel section which are positioned in adjacent pixel rows, the first pixel section comprises a plurality of continuous first pixels with first gray scales, the second pixel section comprises a plurality of continuous second pixels which are with second gray scales and positioned in the same pixel row with the first pixel sections, and a difference value between the first gray scales and the second gray scales is larger than or equal to a first threshold value;

the compensation module is configured to: if the next frame of image comprises the specific graph, determine information to be compensated according to positions of the first pixel section and the second pixel section, a quantity of the first pixels or a quantity of the second pixels and the difference value between the first gray scale and the second gray scale, wherein the information to be compensated comprises a position of an area to be compensated and a compensation level of the area to be compensated; embed the information to be compensated into a transmission signal for transmitting the display data, and send the transmission signal to a driving chip.

10. The driving system according to claim 9, wherein the display data comprises grayscale information of k pixels, the compensation module comprises:

a first parameter register, configured to encode pixels at a start position of the area to be compensated;

a second parameter register, configured to encode pixels at an end position of the area to be compensated;

a third parameter register, configured to encode a compensation level of pixels at the start position;

a fourth parameter register, configured to encode a compensation level of pixels at the end position;

the first parameter register and the second parameter register are both n-bit registers, and $2^n \geq k$; the third parameter register and the fourth parameter register are m-bit registers, $a2^m$ is equal to an adjustment range of a compensation voltage, m, n and k are integers greater than or equal to 1, and a is an adjustment amplitude.

11. The driving system according to claim 10, wherein the driving chip comprises:

a digital part, configured to receive the transmission signal, decode the transmission signal to obtain the information to be compensated and the display data, and generate a digital display signal according to the start position, the end position, the compensation level of the start position and the compensation level digital compensation signal of the end position, and gray scale information of each pixel in the compensation area in the display data;

an analog part, configured to convert the digital compensation signal into a compensation voltage in an analog form, convert the digital display signal into an original driving voltage in an analog form, and adjust the original driving voltage of the corresponding pixel according to the compensation voltage of each pixel to determine a compensated driving voltage of each of the pixels within the compensation region.

12. The driving system according to claim 11, wherein the analog part comprises:

a first digital-to-analog converter, electrically connected to the digital part and configured to convert the digital display signal into the original driving voltage of each of the pixels in an analog form;

a second digital-to-analog converter electrically connected to the digital part and configured to convert the digital compensation signal into a compensation voltage of each of the pixels in an analog form; and a buffer, comprising a plurality of subtractors and a plurality of amplifiers, each subtractor is electrically connected with one amplifier, each subtractor is configured to adjust the original driving voltage of the corresponding pixel according to the compensation voltage of the pixel to generate a voltage to be amplified, and the amplifiers are configured to amplify the voltage to be amplified to generate a compensated driving voltage of the pixel.

13. The driving system according to claim 8, wherein the next frame of image comprises s display regions, s being an integer greater than or equal to 2;

the main control board further comprises a signal input end, wherein the signal input end is configured to receive the display data of the next frame of image in s steps, and receive the display data of the display area of the next frame of image in each step.

14. A liquid crystal display device, comprising a driving system;

wherein the driving system comprises:

a main control board, configured to:

receive display data of a next frame of image, wherein the display data comprises gray scale information of each pixel in the next frame of image;

determine whether the next frame of image comprises a specific graph according to the gray scale information of each pixel, wherein the specific graph comprises a first pixel section and a second pixel section which are positioned in adjacent pixel rows, the first pixel section comprises a plurality of continuous first pixels with first gray scales, the second pixel section comprises a plurality of continuous second pixels which are with second gray scales and positioned in the same pixel row with the first pixel sections, and a difference value between the first gray scales and the second gray scales is larger than or equal to a first threshold value;

if the next frame of image comprises the specific graph, determine information to be compensated according to positions of the first pixel section and the second pixel section, a quantity of the first pixels or a quantity of the second pixels and the difference value between the first gray scale and the second gray scale, wherein the information to be compensated comprises a position of an area to be compensated and a compensation level of the area to be compensated; embed the information to be compensated into a transmission signal for transmitting the display data, and send the transmission signal to a driving chip;

a driving chip is configured to receive the transmission signal, decode the transmission signal to obtain the information to be compensated and the display data, and generate a compensated driving voltage according to the position of the area to be compensated, the compensation level of the area to be compensated, and the gray scale information of each pixel in the area to be compensated, wherein the compensated driving voltage is configured to drive the pixel in the area to be compensated in the liquid crystal panel.

15. The liquid crystal display device according to claim 14, wherein the main control board comprises a graphic detection module and a compensation module;

the graphic detection module is configured to determine whether the next frame of image comprises a specific graph according to the gray scale information of each pixel, wherein the specific graph comprises a first pixel section and a second pixel section which are positioned in adjacent pixel rows, the first pixel section comprises a plurality of continuous first pixels with first gray scales, the second pixel section comprises a plurality of continuous second pixels which are with second gray scales and positioned in the same pixel row with the first pixel sections, and a difference value between the first gray scales and the second gray scales is larger than or equal to a first threshold value;

the compensation module is configured to: if the next frame of image comprises the specific graph, determine information to be compensated according to positions of the first pixel section and the second pixel section, a quantity of the first pixels or a quantity of the second pixels and the difference value between the first gray scale and the second gray scale, wherein the information to be compensated comprises a position of an area to be compensated and a compensation level of the area to be compensated; embed the information to be compensated into a transmission signal for transmitting the display data, and send the transmission signal to a driving chip.

16. The liquid crystal display device according to claim 15, wherein the display data comprises grayscale information of k pixels, the compensation module comprises:

a first parameter register, configured to encode pixels at a start position of the area to be compensated;

a second parameter register, configured to encode pixels at an end position of the area to be compensated;

a third parameter register, configured to encode a compensation level of pixels at the start position;

a fourth parameter register, configured to encode a compensation level of pixels at the end position;

the first parameter register and the second parameter register are both n-bit registers, and $2^n \geq k$; the third parameter register and the fourth parameter register are m-bit registers, $a2^m$ is equal to an adjustment range of a compensation voltage, m, n and k are integers greater than or equal to 1, and a is an adjustment amplitude.

17. The liquid crystal display device according to claim 16, wherein the driving chip comprises:

a digital part, configured to receive the transmission signal, decode the transmission signal to obtain the information to be compensated and the display data, and generate a digital display signal according to the start position, the end position, the compensation level of the start position and the compensation level digital compensation signal of the end position, and gray scale information of each pixel in the compensation area in the display data;

an analog part, configured to convert the digital compensation signal into a compensation voltage in an analog form, convert the digital display signal into an original driving voltage in an analog form, and adjust the original driving voltage of the corresponding pixel according to the compensation voltage of each pixel to determine a compensated driving voltage of each of the pixels within the compensation region.

18. The liquid crystal display device according to claim 17, wherein the analog part comprises:

a first digital-to-analog converter, electrically connected to the digital part and configured to convert the digital display signal into the original driving voltage of each of the pixels in an analog form;

a second digital-to-analog converter electrically connected to the digital part and configured to convert the digital compensation signal into a compensation voltage of each of the pixels in an analog form; and a buffer, comprising a plurality of subtractors and a plurality of amplifiers, each subtractor is electrically connected with one amplifier, each subtractor is configured to adjust the original driving voltage of the corresponding pixel according to the compensation voltage of the pixel to generate a voltage to be amplified, and the amplifiers are configured to amplify the voltage to be amplified to generate a compensated driving voltage of the pixel.

19. The liquid crystal display device according to claim 14, wherein the next frame of image comprises s display regions, s being an integer greater than or equal to 2;

the main control board further comprises a signal input end, wherein the signal input end is configured to receive the display data of the next frame of image in s steps, and receive the display data of the display area of the next frame of image in each step.

* * * * *